United States Patent [19]

Brannan

[11] Patent Number: 4,595,468

[45] Date of Patent: Jun. 17, 1986

[54] CATHODE FOR ELECTROLYSIS CELL

[75] Inventor: James R. Brannan, Perry, Ohio

[73] Assignee: Eltech Systems Corporation, Boca Raton, Fla.

[21] Appl. No.: 632,227

[22] Filed: Jul. 19, 1984

[51] Int. Cl.[4] ..... C25B 1/16; B05D 3/10

[52] U.S. Cl. ..... 204/98; 204/43.1; 204/49.2; 204/242; 204/252; 204/290 R; 427/126.6; 427/352

[58] Field of Search ..... 204/35.1, 38.5, 43.1, 204/44.2, 98, 128, 242, 252, 290 R; 427/126.6, 352

[56] References Cited

U.S. PATENT DOCUMENTS

| | | | |
|---|---|---|---|
| 2,790,707 | 4/1957 | Johnson | 204/98 |
| 4,055,476 | 10/1977 | Benezra et al. | 204/98 |
| 4,086,150 | 4/1978 | Kindl et al. | 204/98 |
| 4,104,133 | 8/1978 | Brannan et al. | 204/25 |
| 4,170,536 | 10/1979 | Kawasaki et al. | 204/35.1 |
| 4,184,941 | 1/1980 | Carlin | 427/352 |
| 4,230,543 | 10/1980 | Kawasaki et al. | 204/98 |
| 4,238,311 | 12/1980 | Kasuya | 204/290 R |
| 4,250,004 | 2/1981 | Miles et al. | 204/35.1 |
| 4,276,134 | 6/1981 | Porta et al. | 204/153 |
| 4,331,517 | 5/1982 | Rechlicz | 204/35.1 |
| 4,337,127 | 6/1982 | Copeland | 204/98 |
| 4,367,126 | 1/1983 | Sato et al. | 204/98 |
| 4,384,928 | 5/1983 | Hall | 204/290 R |
| 4,384,932 | 5/1983 | Gray | 204/290 R |
| 4,394,231 | 7/1983 | Nicolas | 204/98 |
| 4,436,599 | 3/1984 | Bissot et al. | 204/98 |

FOREIGN PATENT DOCUMENTS

| | | | |
|---|---|---|---|
| 0094577 | 11/1983 | European Pat. Off. | 204/290 R |

*Primary Examiner*—Andrew H. Metz
*Assistant Examiner*—Terryence Chapman
*Attorney, Agent, or Firm*—Arthur S. Collins

[57] ABSTRACT

A cathode for the electrolysis of brine for the production of chlorine and caustic soda, whereby chlorate ions are produced, comprises a coating of e.g. Nickel alloyed with a metallic sacrificial component, the latter being leached out by a soltuion of sodium hydroxide. The remaining sodium hydroxide within the pores of the leached nickel coating is transformed into iron hydroxide upon application of an iron salt onto the nickel coating. The iron hydroxide acts as a suppressor for the excessive formation of chlorate ions in the caustic soda solution of the electrolysis cell.

13 Claims, 1 Drawing Figure

CATHODE FOR ELECTROLYSIS CELL

FIELD OF INVENTION

The present invention relates to a cathode for use in an electrolysis cell for the production of chlorine and caustic soda from brine whereby chlorate ions are produced, the cathode including an electrochemically catalytic surface coating. The invention further relates to a method of manufacture the above cathode, to an electrolysis cell comprising the above cathode, and finally relates to a method of producing caustic soda.

BACKGROUND OF INVENTION

It is well known in the art of producing chlorine and caustic soda by electrolysis of brine e.g. in a diaphragm cell, that the caustic solution produced therein contains an undesired high concentration of $ClO_3^-$ (chlorate) ions.

It is also known to eliminate these chlorate ions by reducing them to chloride ions which may diffuse to the anode and be released together with the anodically produced chlorine gas.

U.S. Pat. No. 4,276,134 discloses a method of eliminating chlorate ions from the caustic solution by the employment of metallic iron, which is dissolved in the caustic solution sufficiently to reduce all existing chlorate ions, whereupon the contaminating iron ($Fe^{2+}$ and/or $Fe^{3+}$) is removed from the solution by electrodeposition of the iron onto a cathodically polarized substrate. In turn, the electrodeposited iron is again used to be dissolved in a fresh caustic solution to reduce chlorate ions. Even though the used iron is recycled, there are substantial losses of iron, which therefore has to be constantly added.

Typically the concentration of chlorate ions within the caustic solution being produced by electrolysis of brine is in the order of several hundred to a thousand ppm. The above U.S. patent reports a reduction of this concentration down to a few ppm.

To carry out the above procedure it is necessary to provide two different containers in which the two different steps of the described method (dissolving the iron and re-electroplating the dissolved iron ions) may be carried out, furtheron a rather complicated operation is employed to continually de-chlorate the produced caustic solution by circulating it from one container to the other and finally expensive inert anodes and from time to time replaceable cathodes for the electroplating are needed.

U.S. Pat. No. 4,436,599 discloses a process for producing an iron-activated cathode whereby the iron, which is applied to the cathode by adding to the cathode compartment within a chlor-alkali cell a certain amount of a ferrite solution, brings about a desired drop of the overvoltage.

However, this patent does not disclose the beneficial effect of iron in respect of the reduction of the chlorate concentration, and further, uses a procedure, whereby ferrite has to be constantly added to the cell contents, which contaminates the cell liquor and, consequently, has to be removed therefrom afterwards.

OBJECT OF INVENTION

It is an object of the present invention to provide a cathode for use in an electrolysis cell for the production of chlorine and caustic soda from brine the employment of which yields a caustic solution with a very low concentration of chlorate ions.

It is another object of the present invention to provide a method of manufacturing the above cathode, and finally it is an object of the present invention to produce caustic soda whereby the creation of sodium chlorate is suppressed without additional procedural steps following the proper electrolysis of the brine.

DETAILED DESCRIPTION OF THE INVENTION

The cathodes of an electrolysis cell for brine, e.g. a diaphragm cell, may be coated with a porous layer of Ni, one of the advantages of such layers being a decrease of the cell voltage. Unfortunately however, these coatings yield higher concentrations of chlorate ions in the caustic solution.

Such Ni layers may be produced by coating an alloy of Ni with a sacrificial metallic component such as aluminum or zinc onto a common substrate, which may consist of steel, like steel plates, expanded steel mesh, reticulate structures and others. The coated substrate is then immersed in a leaching solution normally containing sodium hydroxide to at least partially leach out the metallic sacrificial component.

A cathode is prepared by coating a common substrate with a Ni/Al layer, whereby at least a part of the Al is leached out in sodium hydroxide.

When the Al is leached out, a certain amount of sodium hydroxide rests within the pores of the Ni structure. The present invention takes advantage of this fact and suggests to apply non-metallic iron onto the coating, to replace the sodium with iron and thus form iron hydroxide ($Fe(OH)_2$ or $Fe(OH)_3$) which remains within the pores of the Ni structure.

However, when the cathode is dried in air, or baked at 350° to 360° C. to cure a modified asbestos diaphragm, the hydroxide can oxidize to $Fe_2O_3$.

As stated in the chapter "Background of Invention" it was known already that chlorate ions may be reduced to non-contaminating chloride by means of metallic iron, which dissolves in a caustic solution, but this iron had to be added to the electrolyte by means of a separate anodic dissolution procedure. The present invention provides a cathode which includes already non-metallic iron, which does not deplete therefrom and yet suppresses the excessive formation of chlorate ions.

Without being bound to a certain theory it is believed that the non-metallic iron contained within the pores of the Ni coating acts as a catalyst for the reduction of chlorate ions to chloride ions, such that the chlorate ions being created during the electrolysis process are more or less immediately transformed without removing the non-metallic iron from the pores. Consequently, the cathodes remain stable in respect of their chlorate suppressing effect without depleting the inclusions of non-metallic iron from the pores.

The application of the non-metallic iron onto the porous Ni coating may be carried out by any convenient process like spraying, painting or dipping the cathode into a solution containing $Fe^{2+}$ or $Fe^{3+}$ ions with any anions which form a soluble iron salt. The cathode being submitted to the above treatment with regard to the application of non-metallic iron may be rinsed after the leaching out of the sacrificial Al, the sodium hydroxide ions in the pores being sufficiently stable to remain within the pores during a rinsing treatment. This rinsing treatment assures that the iron contents of the doping solution are not wasted by reacting with the sodium hydroxide which only superficially adheres at the surface of the Ni coating.

BRIEF DESCRIPTION OF DRAWING

The only drawing provided herein is a graphic presentation of the sodium chlorate concentrations found in the cell liquors produced in long-term field tests of cathodes of the present invention versus two types of commercial cathodes normally used in diaphragm type chlor-alkali cells.

In addition to the beneficial effect of the invention with respect to the chlorate concentration it was found in the field tests, that the cell voltage was lowered by 20 mV as an average and that the Anox level was considerably lowered in general.

EXAMPLES

Figure 1:
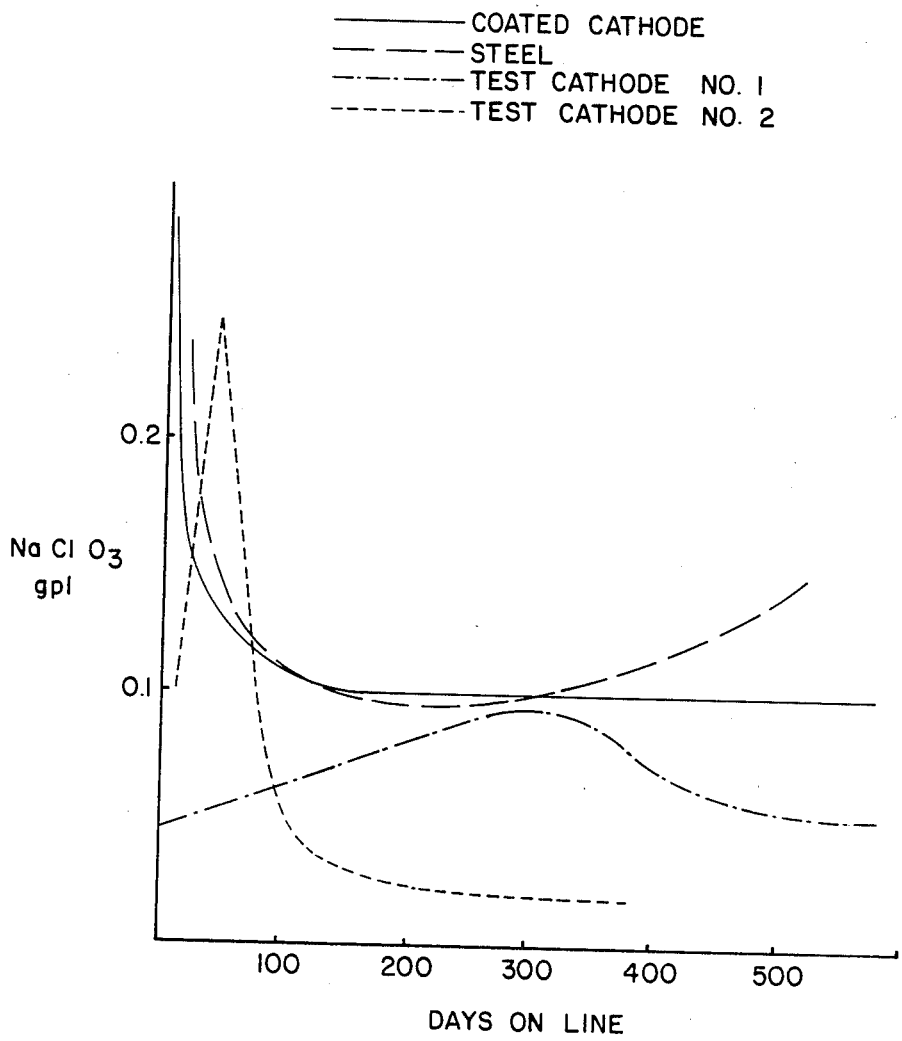

In the following the invention is demonstrated by means of examples and their test results relating to the chlorate concentration in the cell liquor.

EXAMPLE 1

An iron cathode of woven wire mesh and 182 $cm^2$ area was deposited with an asbestos diaphragm containing a PTFE modifier and was baked at 360° C. for 90 minutes according to U.S. Pat. No. 4,410,411. The cathode was then installed in a chlor-alkali test cell fitted with a 161 $cm^2$ DSA anode. The brine feed to the cell was 300 gpl NaCl solution, at pH 3 to 4, and the cell was operated at 25 amps to produce approximately 130 gpl NaOH in the cell liquor. The sodium chlorate in the cell liquor was determined and the average value during cell operation is shown in Table 1.

EXAMPLE 2

An iron mesh cathode of 182 $cm^2$ area was degreased, then derusted in 2 w% HCl solution. The cathode was electroplated at 20 amps for 60 minutes in a nickel chloride solution at 60° to 70° C.; then at 20 amps for 60 minutes in a nickel and zinc chloride solution at 37° to 40° C. The coated cathode was leached overnight in a 100 gpl sodium hydroxide solution to remove the zinc. The cathode was then diaphragmed as in Example 1, installed in a chlor-alkali test cell and operated in the usual manner. Chlorate data are shown in Table 1.

EXAMPLE 3

A steel mesh cathode was plated with nickel and nickel/zinc then leached as in Example 2. The leached cathode was rinsed with deionized water, then dipped in a ferrous chloride solution containing 10 gpl Fe. The cathode was allowed to air dry and had a light brown iron oxide coating. The cathode was diaphragmed and operated as in Example 1 and data are shown in Table 1.

EXAMPLE 4

A steel mesh cathode was plated and leached as in Example 2. It was lightly rinsed before dipping in a ferrous chloride solution containing 10 gpl Fe, and a heavy coating of $Fe(OH)_2$ was deposited on the cathode. The cathode was air dried then diaphragmed and operated as in Example 1. Data are shown in Table 1.

EXAMPLE 5

A steel mesh cathode was prepared for coating as in Example 2, plated at 16 amps for 30 minutes in the $NiCl_2$ solution, then at 16 amps for 60 minutes in the NiZn plating solution, and leached as in Example 2. It was lightly rinsed then sprayed with a ferrous chloride solution containing 10 gpl Fe to deposit a light coating of $Fe(OH)_2$. The cathode was air dried, then diaphragmed and operated as in Example 1. The chlorate data are shown in Table 1.

TABLE 1

Sodium Chlorate Concentration in Cell Liquor

| Example | Days on Line | $NaClO_3$ in Cell Liquor, gpl |
|---|---|---|
| 1 | 31 | 0.28 |
| 2 | 19 | 0.23 |
| 3 | 13 | 0.13 |
| 4 | 33 | 0.05 |
| 5 | 30 | 0.17 |

The above table shows the advantages of a cathode according to the invention (Example 3, 4 and 5) over known cathodes. The values for the chlorate concentration of a cathode according to the invention are approximately half the magnitude of those of all known cathodes.

Field Test

Two commercial cathodes, 23 $m^2$ area, were prepared according to U.S. Pat. No. 4,104,133, in a commercial coating facility. They were plated with an active NiZn coating at 28.5 KA for 60 minutes. Both cathodes were leached overnight. The first was not rinsed after leaching and was sprayed with approximately eight liters of a ferrous chloride solution containing 10 gpl Fe. The second cathode was rinsed before spraying with approximately twelve liters of said ferrous chloride solution. The two cathodes were then air dried, rinsed, deposited with asbestos diaphragms modified with PTFE fibers and baked at 355° C. for 90 minutes as described in U.S. Pat. No. 4,410,411.

FIG. 1 shows sodium chlorate concentration in the cell liquor of the two cells containing the aforesaid cathodes and comparative data for five steel cathodes and five NiZn coated cathodes installed in the same plant at the same time. This indicates the superior performance of the Fe sprayed cathodes.

I claim:

1. A preconditioned cathode ready for use in an electrolysis cell for producing chlorine and caustic soda from brine wherein chlorate ions tend to form also, said cathode having a porous catalytic coating including at least one of nickel, iron or cobalt and formed from an alloy of same with zinc or aluminum by leaching out at least part of said zinc or aluminum with a solution of sodium hydroxide, characterized in that said coating contains a chlorate suppressor solid compound deposited therein by means of a chemical reaction effected between sodium hydroxide solution retained in said coating and a solution containing non-metallic iron applied to said coating containing at least some of said sodium hydroxide solution.

2. The cathode of claim 1, characterized in said chlorate suppressor compound comprising non-metallic iron.

3. The cathode of claim 2, characterized in said chlorate suppressor compound being iron hydroxide.

4. A cathode as in claim 1 wherein the reacting solutions applied to said coating are a solution containing sodium hydroxide and a solution of an iron salt.

5. A cathode as in claim 4 wherein the iron salt is an iron chloride.

6. A method of manufacturing a cathode for use in a chlor-alkali electrolysis cell wherein it is desired to minimize formation of by-product chlorate ions comprising the steps of:

(a) selecting a metal substrate of desired shape having a surface coating thereon of electrocatalytic metal alloyed with a sacrificial metal, (b) leaching out at least a part of said sacrificial metallic component by immersing the coated substrate in a leaching solution which has a high solubility for said sacrificial metallic component, whereby molecules of the solute of said leaching solution are left within the porous structure of the leached coating, and (c) contacting said leached coating with a doping solution the solute of which reacts with the solute of said leaching solution to deposit a solid, chlorate suppressor compound within the porous structure of said leached coating.

7. The method of claim 6, characterized in the leaching solution containing sodium hydroxide.

8. The method of claim 7, characterized in the doping solution containing a soluble iron salt, the iron ions of said doping solution replacing the sodium ions of the sodium hydroxide to form iron hydroxide.

9. A method as described in claim 6 wherein said electrocatalytic metal is one or more of Ni, Fe and Co.

10. An electrolysis cell for producing chlorine and caustic soda from brine wherein unwanted chlorate ions are also formed as a by-product, comprising an anode and a cathode having an electrochemically catalytic surface coating of porous metal including at least one of nickel, iron or cobalt, characterized in that said coating contains a chlorate suppressor solid compound of iron deposited within the porous metal by a chemical reaction between solutions applied to said coating prior to initial operation of the cathode.

11. The cell of claim 10, characterized in the chlorate suppressor compound being iron hydroxide.

12. A method of producing chlorine and caustic soda while hindering the formation of by-product sodium chlorate, which comprises passing electrolysis current through brine between an anode and a cathode having a catalytic coating of porous metal including at least one of nickel, iron and cobalt, said cathode having been preconditioned prior to placing it into initial electrolysis service by depositing within said porous metal coating a chlorate suppressor solid compound of iron as it is formed by an in situ chemical reaction between solutions.

13. The method of claim 12 characterized in the chlorate suppressor compound being iron hydroxide.

* * * * *